US005642715A

United States Patent [19]

Yamakawa et al.

[11] Patent Number: 5,642,715

[45] Date of Patent: Jul. 1, 1997

[54] DISTRIBUTOR TYPE FUEL INJECTION PUMP

[75] Inventors: Toru Yamakawa; Ken'ichi Kubo; Hiroshi Ishiwata; Jun Matsubara, all of Higashimatsuyama, Japan

[73] Assignee: Zexel Corporation, Tokyo, Japan

[21] Appl. No.: 623,955

[22] Filed: Mar. 29, 1996

[30] Foreign Application Priority Data

Apr. 3, 1995 [JP] Japan ..... 7-101743

[51] Int. Cl.[6] ..... F02M 41/00

[52] U.S. Cl. ..... 123/450; 123/300; 123/500

[58] Field of Search ..... 123/450, 299, 123/300, 500, 501, 449, 506

[56] References Cited

U.S. PATENT DOCUMENTS

| | | | |
|---|---|---|---|
| 4,587,940 | 5/1986 | Schmid | 123/500 |
| 4,696,271 | 9/1987 | LeBlanc | 123/299 |
| 4,751,903 | 6/1988 | Cabarroca's Pruneda | 123/450 |
| 4,881,506 | 11/1989 | Hoecker | 123/500 |
| 5,144,925 | 9/1992 | Weiss | 123/500 |
| 5,233,955 | 8/1993 | Kraemer | 123/299 |
| 5,286,178 | 2/1994 | Schaef | 123/299 |

FOREIGN PATENT DOCUMENTS

| | | | |
|---|---|---|---|
| 1209065 | 2/1960 | France | 123/450 |
| 596690 | 4/1934 | Germany | 123/450 |
| 403981 | 6/1932 | United Kingdom | 123/500 |

*Primary Examiner*—Carl S. Miller

*Attorney, Agent, or Firm*—Wenderoth, Lind & Ponack

[57] ABSTRACT

Inflow/outflow ports are provided in either one of a distribution member for distributing compressed fuel or a control sleeve which is externally fitted around the distribution member. Each of the ports includes a slit extending therefrom. At the other one of the distribution member and the control sleeve, an intake-cutoff hole that communicates sequentially with the inflow/outflow ports and a pilot port which communicates with the slits during part of the force feed period are provided. Since the fuel flows out through the slits during part of the force feed period, pilot injection can be more easily achieved prior to the main injection during low speed rotation and fuel is less likely to be diverted through the slits due to the constricting effect during high speed rotation so that only the main injection is performed. As a result, a distributor type fuel injection pump which achieves pilot injection in the idling range and in the no-load range, and cancels the pilot injection in the full-load range is provided.

13 Claims, 7 Drawing Sheets

DISTRIBUTOR TYPE FUEL INJECTION PUMP

BACKGROUND OF THE INVENTION

1. Field of the Invention

The present invention relates to a distributor type fuel injection pump provided with a pilot injection mechanism, used for supplying fuel to an engine, and more specifically, it relates to an inner cam, distributor type fuel injection pump (VR pump) which causes plungers to make reciprocal movement in the direction of the radius of a rotating distribution member and a distributor type fuel injection pump (VE pump) which distributes fuel by causing a distribution member to make rotating and reciprocal movement.

2. Description of the Related Art

In a VR type distributor type fuel injection pump, as disclosed in First Publication No. S59-110835 of Japanese Patent Application, for instance, a concentric inner cam ring 1 is provided around a fuel distribution rotor 4 (distribution member) and force feed plungers 21 and 22 are provided on the cam surfaces formed on the inside of the inner cam ring 1 via a roller or the like so that the force feed plungers 21 and 22 can make reciprocal movement in the direction of the radius of the fuel distribution rotor 4. In the fuel distribution rotor 4, a pump chamber 2 (compression space) whose volumetric capacity is changed by the force feed plungers 21 and 22, intake holes 51–54 through which fuel is taken into the pump chamber 2 during an intake process, a distribution port 6 which, during a force feed process, delivers fuel that has been pressurized in the pump chamber 2 and overflow ports 71–74, which cut off the fuel delivery, are formed. Also, a ring-like member 7 (control sleeve) is externally fired on the fuel distribution rotor 4, covering the overflow ports 71–74 and by moving this ring-like member in the direction of the axis, the cut off timing during the force feed process can be adjusted to vary the fuel injection quantity.

Now for a VE type distributor type fuel injection pump, as disclosed in First Publication No. S54-102420 of Japanese Patent Application, for instance, a plunger 7 (distribution member) is secured to a cam disk 8 which rotates in synchronization with an engine to cause the plunger 7 to rotate and, at the same time, to make reciprocal movement in correspondence to the cam surface of the cam disk. The from end of the plunger faces a space 10 which constitutes a compression space and in the plunger, a longitudinal groove 11 for taking fuel into the space 10 during the intake process, a distribution longitudinal groove 14 for delivering fuel which as been pressurized in the space 10 during the force feed process and a cut off port 17 for cutting off fuel delivery, are formed. Also, a control sleeve is externally fitted on the plunger 7, covering the cut off port 17 and, by moving this control sleeve in the direction of the axis, cut off timing during the force feed process is adjusted to vary the fuel injection quantity.

In these VR and VE type injection pumps, it is desirable to provide a simple mechanism which satisfies the following requirements without changing the basic structure described above. Namely: 1) since, in the idling range and in the no-load range, the combustion temperature is low, flame-out tends to occur, resulting in white smoke and HC being generated, a pilot injection should be performed prior to the main injection in order to ensure reliable combustion during the main injection; 2) on the other hand, if a pilot injection is performed in the full-load range, the characteristics curve for full-load operation would deteriorate, resulting in reduced torque, generation of black smoke and higher fuel consumption. Consequently, in the full-load range, it is desirable to perform only the main injection without the pilot injection; 3) in the small injection range (low load, low speed range), which particularly requires pilot injection, the pilot injection quantity should be reduced as the main injection quantity decreases.

SUMMARY OF THE INVENTION

Bearing in mind the above discussion, an object of the present invention is to provide a distributor type fuel injection pump in which the requirements described above can be satisfied with a simple mechanism without having to add new members.

Through extensive research into mechanical structures that might achieve the object described above, the present invention was developed based upon the observation that pilot injection can be made to occur during low speed rotation and can be canceled during high speed rotation by forming a hole for diverting fuel during part of the force feed period and shaping this hole in such a manner that the fuel is less likely to be diverted as the speed increases and that pilot injection can be made to occur when the injection quantity is small and can be canceled when the injection quantity is large, by ensuring that the effective area of the hole becomes reduced as the injection quantity increases.

Accordingly, the distributor type fuel injection pump according to the present invention is either a VR or VE type fuel injection pump with a control sleeve externally fitted around a distribution member that distributes compressed fuel and is provided with first through holes, the number of which corresponds to the number of distributions, with slits extending from the first through holes, a second through hole that communicates with the first through holes sequentially and a third through hole that communicates with the slits during a part of the force feed period formed at the other of either the control sleeve or distribution member.

In this structure, it is desirable to vary the size of the area where the slits and the third through hole overlap in correspondence to the position of the control sleeve. More specifically, as the control sleeve travels further in the direction in which the fuel quantity increases, the overlapping area of the slits and third through hole is reduced. It is also acceptable to make the first through holes and the third through hole communicate with each other earlier when the control sleeve is positioned in the vicinity of the small injection quantity position, compared to when the control sleeve is at other positions.

Consequently, when the distribution member rotates, the second through hole communicates with the first through holes sequentially to distribute the fuel and the intake process, in which the fuel is taken in, is caused to occur during the period of time in which a first through hole communicates with the second through hole, whereas the force feed process is caused to take place during the period of time after the second through hole is disconnected from the first through hole and before the second through hole comes into communication with the next first through hole. To give a more detailed explanation of this force feed process, after the communication between the second through hole and a first through hole is cut off, force feed of the fuel starts, and when a slit and the third through hole come into communication during this force feed process, the compressed fuel is diverted temporarily. After that, force feed of the fuel takes place until the slit becomes disconnected from the third through hole and a first through hole comes into communication with the second through hole again, and when the first through hole comes into communication with the second through hole, the fuel is diverted, to stop the delivery.

The communication between the slits and the third through hole ensures that while the distribution member rotates at low speed, the compressed fuel is diverted in sufficient quantity to cause pilot injection preceding the main injection, while it is rotating at high speed, the diversion of the compressed fuel is reduced, due to the contracting of the slits, to the extent that the pilot injection cannot be distinguished from the main injection and, as a result, only the main injection is performed.

In particular, by reducing the overlapping area of the slits and the third through hole as the control sleeve travels further in the direction in which the fuel quantity increases, even at a constant pump rotation rate, it is ensured that the overlapping area of the slits and the third through hole increases when the load is low and when the injection quantity is small, resulting in a large diversion quantity, so that pilot injection is performed separately from the main injection, and that the overlapping area of the slits and the third through hole becomes reduced when the load is high and when the injection quantity is large, so that the pilot injection cannot practically be distinguished from the main injection and only the main injection is performed.

In addition, by ensuring that the first through holes come into communication with the third through hole earlier, as the control sleeve moves closer to the small injection quantity position, the pilot injection quantity is reduced as the main injection quantity becomes reduced, thereby eliminating the problem of the pilot injection remaining at a constant quantity even when the main injection quantity has become reduced.

BRIEF DESCRIPTION OF THE DRAWINGS

The above and other features of the invention and the concomitant advantages will be better understood and appreciated by persons skilled in the field to which the invention pertains in view of the following description given in conjunction with accompanying drawings which illustrate preferred embodiments. In the drawings.

DETAILED DESCRIPTION OF THE PREFERRED EMBODIMENT

The following is an explanation of an embodiment of the present invention in reference to the drawings.

Figure 1:
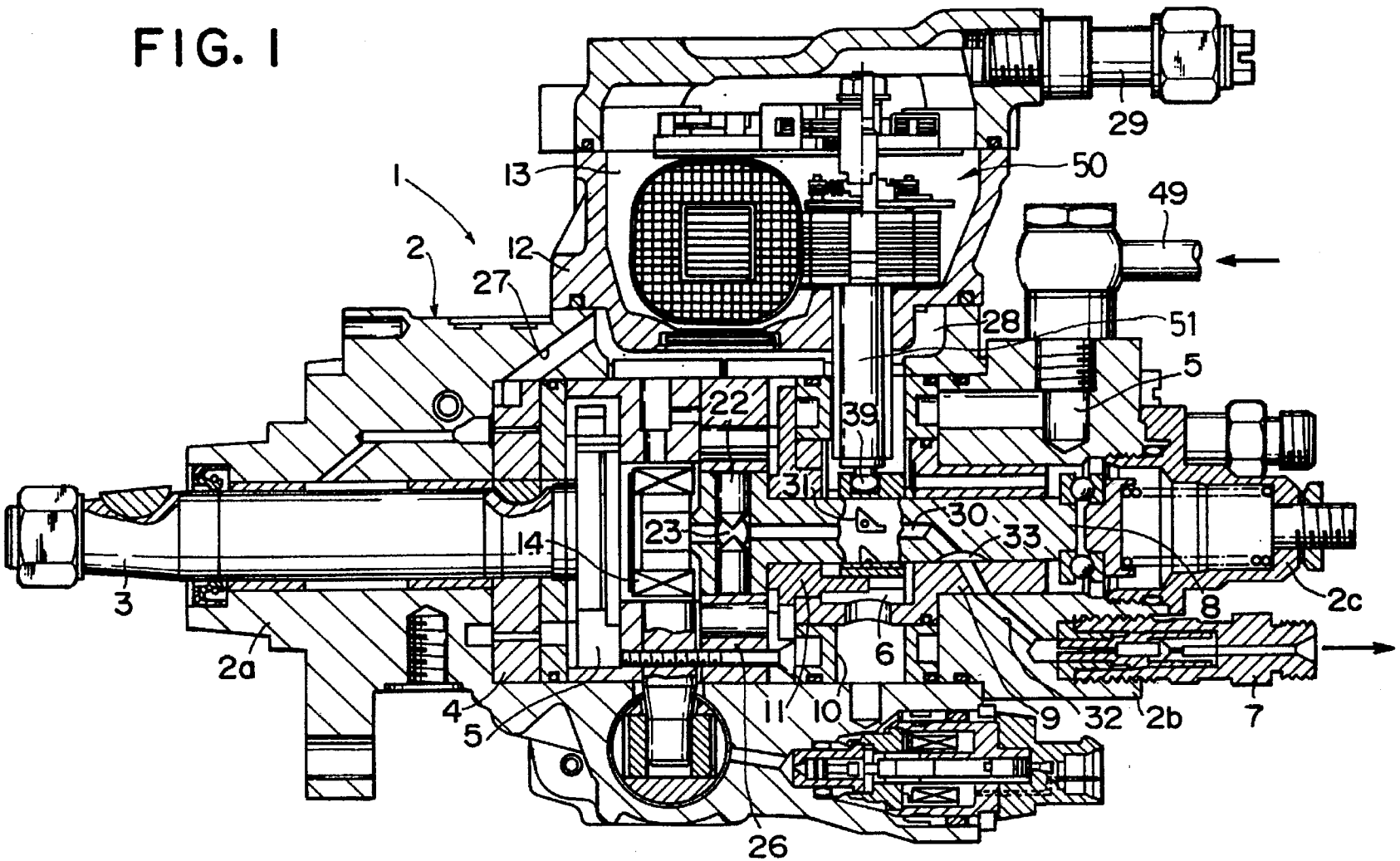
FIG. 1 is a cross section of a VR type distributor type fuel injection pump according to the present invention.

In FIG. 1, which shows an inner cam, distributor type fuel injection pump, a distributor type fuel injection pump 1 is provided with a drive shaft 3 inserted in a pump housing 2, with one end of this drive shaft 3 projecting out to the outside of the pump housing 2 to receive drive torque from an engine (not shown) so that it rotates in synchronization with the engine at a rotation rate that is half the rotation rate of the engine. The other end of the drive shaft 3 extends inside the pump housing 2 and a feed pump 4 is linked with the drive shaft 3 so that fuel can be supplied by the feed pump 4 from the low pressure fuel region, which is to the explained later, to a chamber 6.

The pump housing 2 includes a housing member 2*a* through which the drive shaft 3 is inserted, a housing member 2*b* that is mounted on the housing member 2*a* and is provided with a delivery valve 7 and a housing member 2*c* that blocks the opening end of the housing member 2*b* and is provided on an extended line from the distribution member 8. The chamber 6 is formed by being enclosed by a supporting member 9 provided inside the pump housing, a wall member 10, which holds the supporting member 9 where the supporting member 9 passes through it and an adapter 11, which is to be explained later. The chamber 6 communicates with a governor housing chamber 13 which is defined by a governor housing 12. In addition, a side portion of the supporting member 9 projects out to be fitted in the housing member 2*b*.

Figure 2:
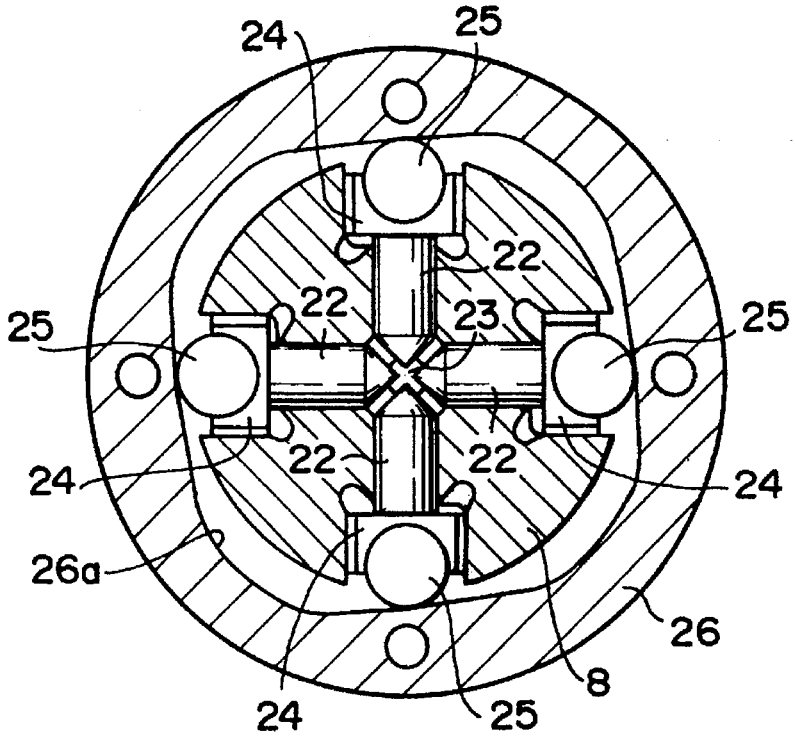
FIG. 2 is an enlarged cross section of a cam ring shown in FIG. 1 and members provided inside it, viewed from the direction of the axis of a distribution member.
Figure 3:
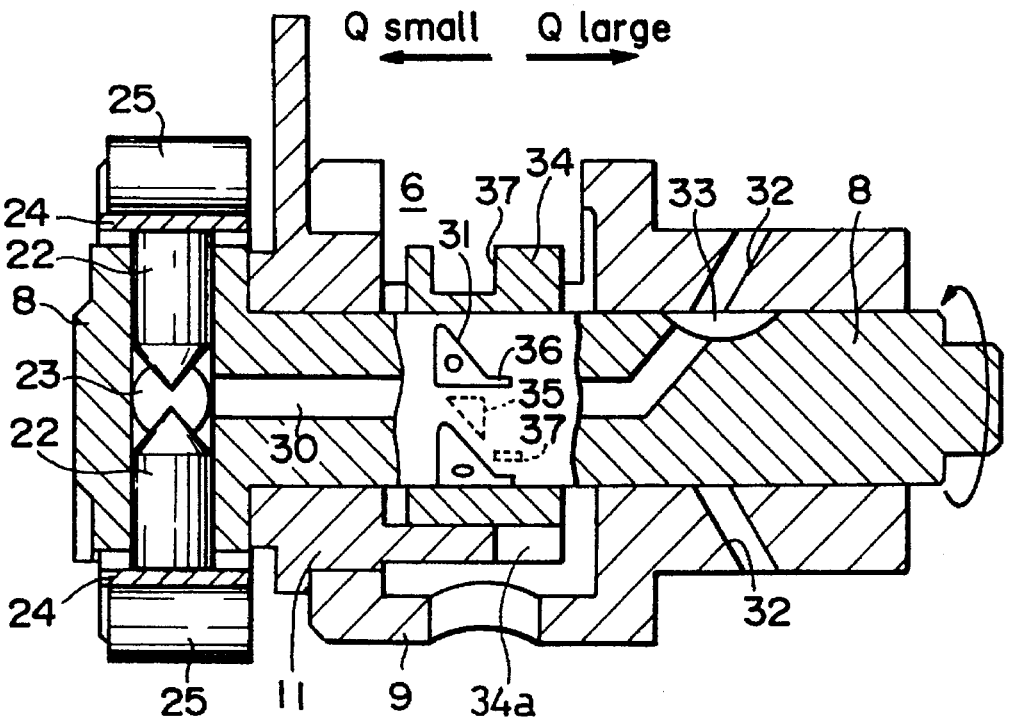
FIG. 3 is an enlarged cross section showing the distribution member and members surrounding it.
Figure 4A:
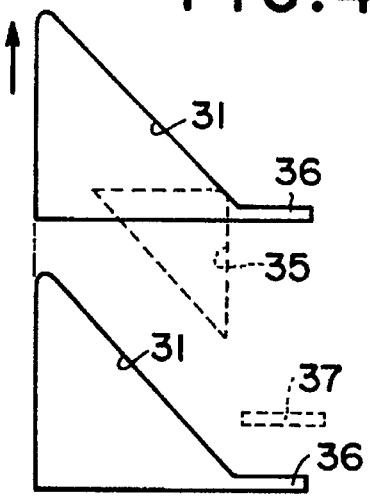
FIG. 4 shows the changes in positional relationships among inflow/outflow ports, slits, an intake-cutoff hole and a pilot port as the distribution member rotates, with FIG. 4A illustrating fuel intake, FIG. 4B illustrating pilot injection, FIG. 4C illustrating pilot diversion, FIG. 4D illustrating main injection and FIG. 4E illustrating main diversion.
Figure 4B:
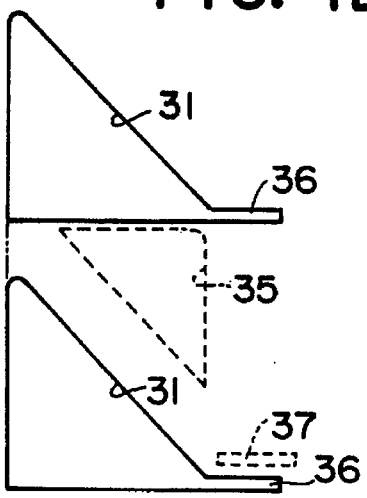
Figure 4C:
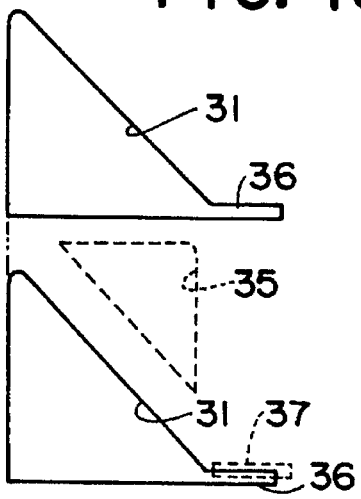
Figure 4D:
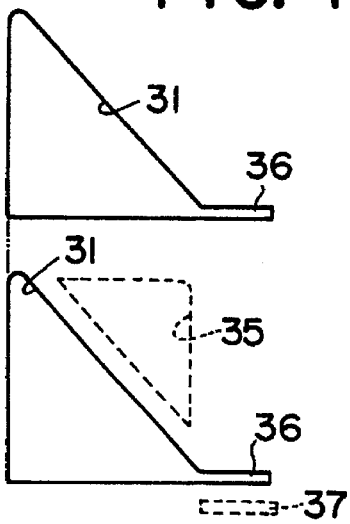
Figure 4E:
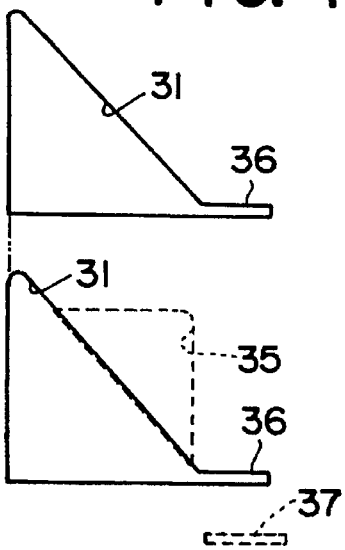

A distribution member 8 is supported at a through hole in the supporting member 9 in such a manner that it can rotate freely, with its base end portion linked to the drive shaft 3 via a coupling 14 so that it rotates only with the rotation of the drive shaft 3. In addition, at the base end portion of the distribution member 8, as shown in FIGS. 2 and 3, plungers 22 are inserted in the direction of the radius (radial direction) in such a manner that they can slide freely.

In this embodiment, four plungers 22 are provided on a flat plane over, for instance, 90° intervals and the from end of each plunger 22 faces a compression space 23, which is provided at the center of the base end portion of the distribution member 8, so as to seal it. The base ends of the plungers 22 slide against the internal surface of a ring-like cam ring 26 via shoes 24 and rollers 25. This cam ring 26 is provided concentrically to and around the distribution member 8 and is provided with cam surfaces 26*a* on the inside thereof, the number of which corresponds to the number of cylinders in the engine. When the distribution member 8 rotates, the plungers 22 make reciprocal movement in the direction of the radius of the distribution member 8 (radial direction) to change the volumetric capacity of the compression space 23.

In summary, the cam ring 26, if it is constituted in correspondence to a four cylinder engine, is provided with projected surfaces every 90° on its inside and, as a result, the four plungers 22 will travel simultaneously toward the compression space 23 to compress it by contracting it and will travel away from the center of the cam ring 26 simultaneously.

A ring-like adapter 11 is externally fitted on the distribution member 8 with a good oil-tight seal in such a manner that it can rotate freely and the rotation of this adapter 11 is restricted with a portion of its circumferential edge being held at the cam ring 26 so that it can only rotate along with the cam ring 26. In addition, the adapter 11 is mounted at the supporting member 9 with a good oil-tight seal in such a manner that it can rotate freely.

A fuel inflow port 49, which communicates with a fuel tank, is formed at the housing member 2b and fuel that flows in through this fuel inflow port 49 is led toward the intake side of the feed pump 4 via the space formed around the supporting member 9, the wall member 10 and the adapter 11, the space formed between the cam ring 26 and the distribution member 8, a passage formed around the coupling 14 and the like, and these spaces and the passage constitute a low pressure fuel region 5 which extends from the fuel inflow port 49 to the feed pump 4.

Also, fuel that has been compressed by the feed pump 4 is led to the chamber 6 through a passage 27 formed in the upper portion of the pump housing and a gap 28 formed between the pump housing 2 and the governor housing 12 that is mounted on the pump housing 2, and it is also led to an overflow valve 29 via the governor housing chamber 13 so that a high pressure fuel region 6 is formed with these communicating elements.

A longitudinal hole 30 is formed in the distribution member 8 and extends along a direction of the axis thereof. The longitudinal hole 30 communicates with the compression space 23 and with inflow/outflow ports 31 which are formed in the distribution member 8. The number of inflow/outflow ports 31 corresponds to the number of cylinders. Also, a distribution port 33 is formed in the distribution member and provides communication between the longitudinal hole 30 and distribution passages 32 formed in the supporting member 9 and the housing member 2b. As shown in FIG. 4, the portions of the inflow/outflow ports 31 that open onto the surface of the distribution member 8 are triangular, with the side of each triangle toward the rear or trailing in the direction of rotation running parallel to the direction of the axis of the distribution member 8 and the side toward the front, or leading constituting the hypotenuse, which inclines at a specific angle relative to the direction of the axis of the distribution member 8. In addition, a control sleeve 34 is externally fitted on the distribution member 8, covering the inflow/outflow ports 31 in such a manner that it can slide freely.

As shown in FIG. 4, an intake-cutoff hole 35, which can communicate with the inflow/outflow ports 31, is formed in the control sleeve 34. The intake-cutoff hole 35 is formed in a triangular shape, with the side that determines the timing with which it starts to communicate with an inflow/outflow port 31 constituting the hypotenuse, which inclines at a specific angle relative to the direction of the axis of the distribution member 8, and the side that determines the timing with which its communication with the inflow/outflow port 31 ends, running parallel to the direction of the axis of the distribution member 8.

In addition, at each inflow/outflow port 31, a slit 36 extends in the direction of the axis and a pilot port 37, which can communicate with these slits, is formed in the control sleeve 34. This pilot port 37 is formed in a slit shape, extending in the direction of the axis and it is ensured that the pilot port 37 communicates with a slit 36 before an inflow/outflow port 31 comes into communication with the intake-cutoff hole 35. Also, the area where the pilot port 37 overlaps with the slit 35 becomes reduced as the control sleeve 34 travels further in the direction in which the injection quantity increases, and when the control sleeve 34 is at a small injection quantity position, the pilot port 37 is positioned at a location where it engages the hypotenuse of an inflow/outflow port so that it communicates with the inflow/outflow port 31 before it communicates with slit 36.

Note that a ball portion 39 of a shaft 51 of an electric governor 50, which is accommodated in the governor housing chamber 13, is connected to the control sleeve 34 and that when the shaft 51 is rotated by a signal from the outside, the control sleeve 34 is caused to travel in the direction of the axis of the distribution member 8. In addition, in the lower portion of the control sleeve 34, a groove 34a which extends in the direction of the axis is formed with a portion of the adapter 11 connected in this groove 34a to ensure that the phases of the adapter 11 and the control sleeve 34 are always maintained at a specific phase relationship.

In the structure described above, when the distribution member 8 rotates, the inflow/outflow ports 31, the number of which corresponds to the number of cylinders, come into communication with the intake-cutoff hole 35 sequentially, and during an intake process in which the plungers 22 move away from the center of the cam ring 26, an inflow/outflow port 31 and the intake-cutoff hole 35 are aligned with each other (see FIG. 4A) so that fuel in the chamber 6 is taken into the compression space 23.

Then, when the operation enters the force feed process, in which the plungers 22 travel toward the center of the cam ring 26, the communication between the inflow/outflow port 31 and the intake-cutoff hole 35 is cut off (see FIG. 4B), the distribution port 33 becomes aligned with one of the distribution passages 32 and the compressed fuel is discharged to a delivery valve 7 via a distribution passage 32. Note that the fuel which is delivered via the delivery valve 7 is then sent to an injection nozzle via an injection pipe (not shown) and is injected from the injection nozzle into a cylinder of the engine.

When the slit 36 of an inflow/outflow port 31 comes into communication with the pilot port 37 (see FIG. 4C) during the force feed process, the compressed fuel temporarily flows out into the chamber 6 so that the delivery of fuel to the injection nozzle is temporarily inhibited. Then, when the slit 36 of the inflow/outflow port 31 is no longer aligned with the pilot port 37 (see FIG. 4D), the fuel is force fed to the delivery valve 7 again to be injected from the injection nozzle and the main injection starts. Next, when an inflow/outflow port 31 and the intake-cutoff hole 35 come into communication with each other again (see FIG. 4E), the compressed fuel flows into the chamber 6, delivery of fuel to the injection nozzle stops and the injection ends.

In this structure, since the inflow/outflow ports 31 and the intake-cutoff hole 35 are formed with triangular shapes, as explained above, the timing with which the inflow/outflow ports 31 come into communication with the intake-cutoff hole 35 can be varied by adjusting the position of the control sleeve 34. In other words, through the positional adjustment of the control sleeve 34, injection end, i.e., injection quantity, can be controlled. As the control sleeve 34 is made to travel further to the left in FIG. 3 (toward the base end portion of the distribution member 8) the injection quantity is reduced, whereas, as it is made to travel further to the right (toward the front end portion of the distribution member 8) the injection quantity is increased.

Figure 5A:
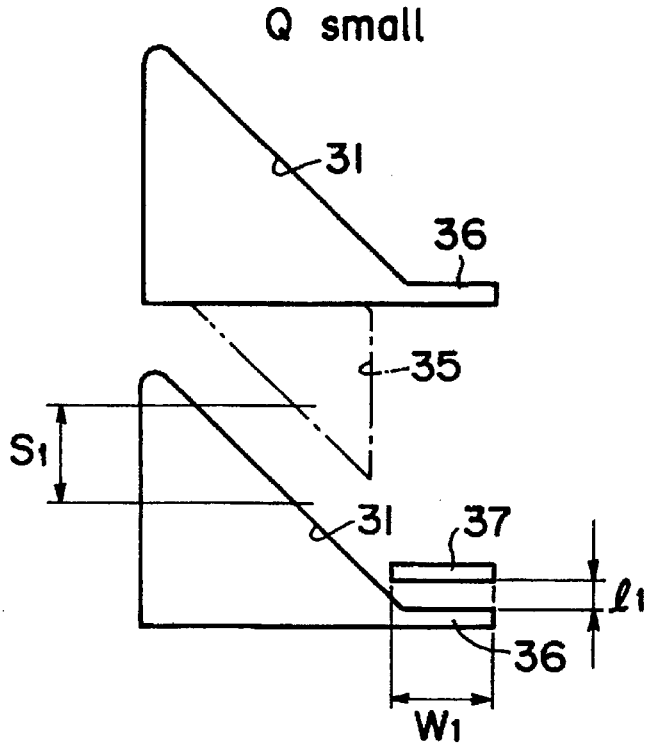
FIG. 5A and 5B illustrate the positional relationships among inflow/outflow ports, slits, an intake-cutoff hole and a pilot port as the position of the control sleeve is adjusted.
Figure 5B:
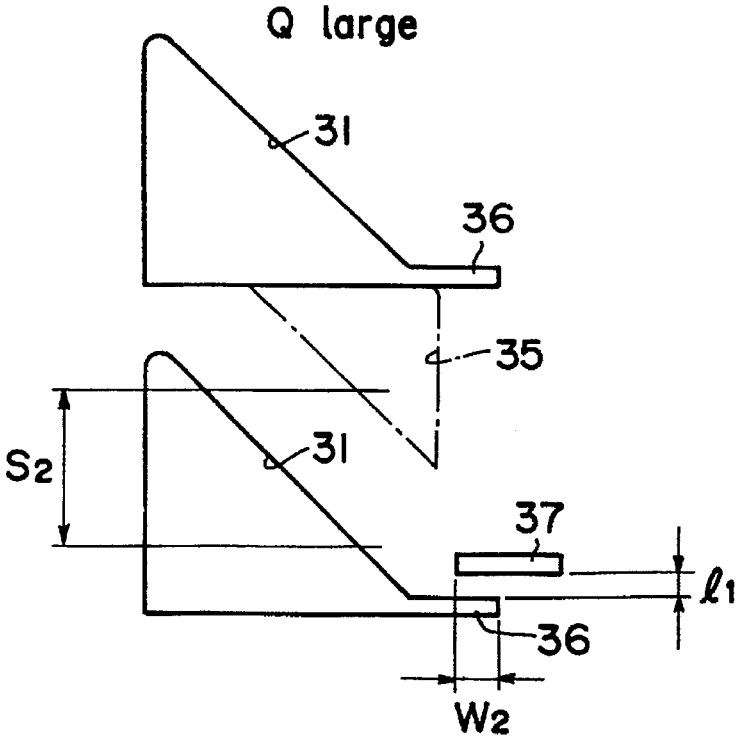

To give a more specific explanation, when the control sleeve 34 is set at the small injection quantity position, the effective stroke S1 is small during the time period after the communication between the intake-cutoff hole 35 and an inflow/outflow port 31 is cut off until the intake-cutoff hole 35 comes into communication with the next inflow/outflow port 31, as shown in FIG. 5A, and the width W1 over which the slit 36 of the inflow/outflow port 31 overlaps the pilot port 37 is large. In contrast, when the control sleeve 34 is set at the large injection quantity position, the intake-cutoff hole 35 moves further away from the hypotenuse of the inflow/outflow ports 31 resulting in a large effective stroke S2 (S2>S1), as shown in FIG. 5B, and also, the width W2 over which the slits 36 of the inflow/outflow ports 31 overlap the pilot port 36 becomes small (W2<W1).

Figure 6:
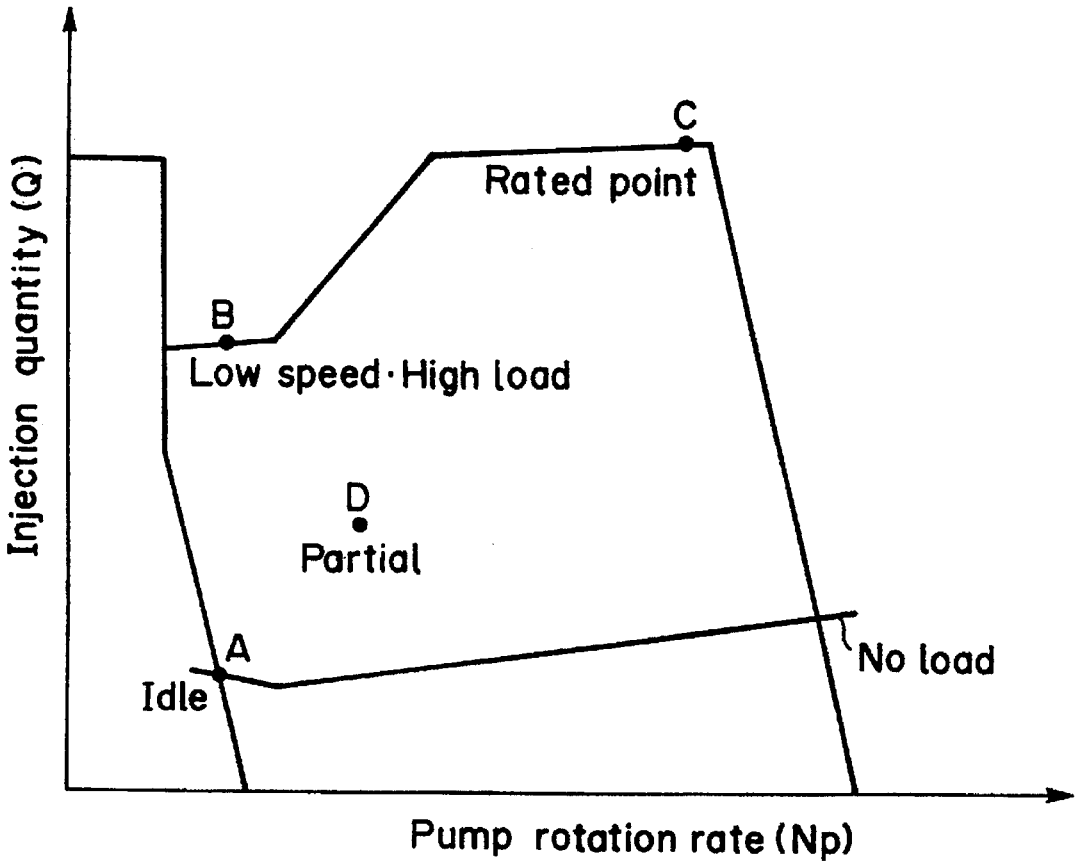
FIG. 6 is a characteristics diagram showing the relationship between the injection quantity (Q) and the pump rotation rate (Np)
Figure 7A:
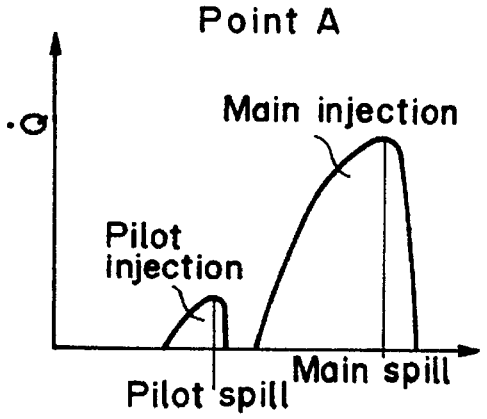
FIG. 7A–7D shows the injection rate characteristics (dQ/dt at points A, B, C and D in FIG. 6.

As a result, in the low speed, low load range (low speed, small injection quantity range), as indicated with point A in FIG. 6, for instance, which corresponds to the idling range, the effective stroke is small, the size of the area over which slits 36 and the pilot port 37 overlap each other is large and the pump rotation rate (Np) is low. Consequently, when a slit 36 comes into communication with the pilot port 37, the compressed fuel is diverted in sufficient quantity to halt the injection temporarily and, as shown in FIG. 7A, a pilot injection takes place prior to the main injection. With this pilot injection, ignition of the main injection will be smooth. As a result, combustion noise in the idling range is reduced and the amount of white smoke generated is reduced.

Figure 7B:
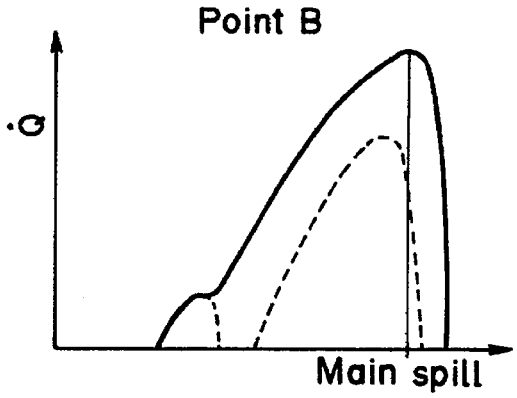

When the control sleeve 34 is moved further in the direction in which the injection quantity increases, from the state indicated with point A, to point B, for instance, in the low speed, high load range (low speed, large injection quantity range), the effective stroke becomes large, the size of the area over which the slits 36 and the pilot port 37 overlap each other is reduced and even when the slits 36 come into communication with the pilot port 37, the diversion quantity of compressed fuel is small. Consequently, as shown in FIG. 7B, even though the injection is somewhat restricted at the point in time when the communication occurs, the operation shifts to the main injection without being halted temporarily. Thus, in such a full-load range, the pilot injection is canceled, solving the problem of not being able to obtain sufficient torque, achieving an improvement in fuel consumption characteristics and reducing the generation of black smoke.

Figure 7C:
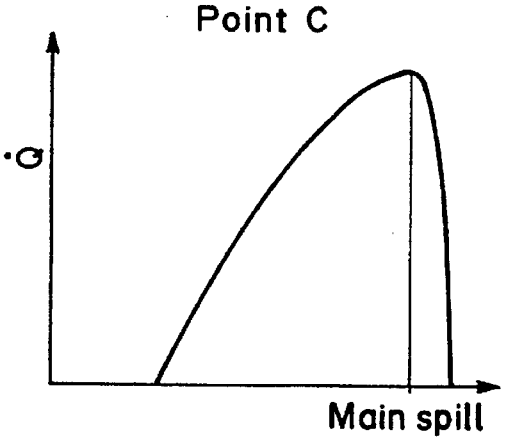

Moreover, when the rotation rate of the pump increases and the control sleeve 34 moves to point C, for instance, in the high speed, high load range (high speed, large injection quantity range), since the effective stroke is large, the size of the area over which the slits 36 and the pilot port 37 overlap each other is small and the pump rotation rate is high, the constricting effect will be imparted by the slits 36 and the pilot port 37 so that only negligible diversion of compressed fuel occurs, even when the slits 36 come into communication with the pilot port 37, and only the main injection is performed, as shown in FIG. 7C.

Figure 7D:
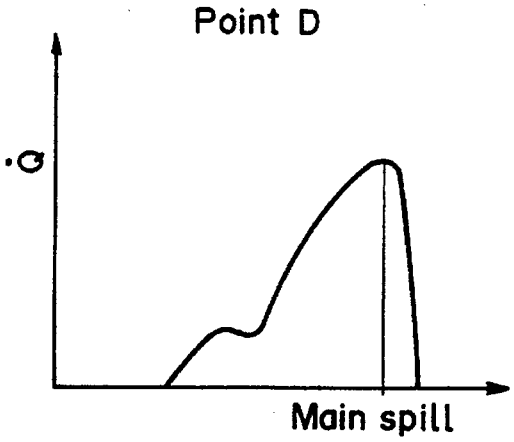

In addition, in the partial range (medium speed, medium injection quantity range) indicated with point D, for instance, the size of the area over which the slits 36 overlap the pilot port 37 is smaller than that during idling and the constricting effect still occurs to a certain extent, because pump rotation is at a medium level. Thus, even when the slits 36 come into communication with the pilot port 37, the quantity of compressed fuel diverted is smaller than the quantity diverted during idling and, as shown in FIG. 7D, although the injection will be somewhat inhibited at the point in time when a slit 36 comes into communication with the pilot port 37, the operation shifts to the main injection without being halted.

Figure 8:
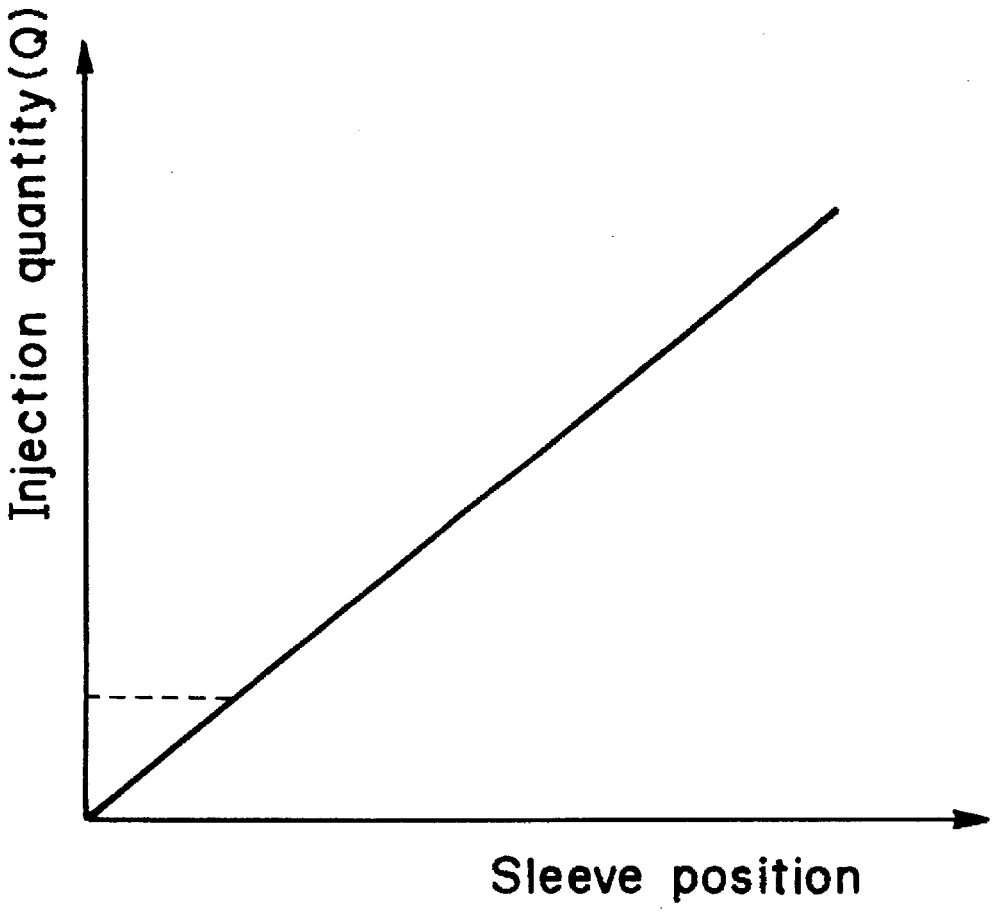
FIG. 8 is a characteristics diagram showing the relationship between the injection quantity and the control sleeve position.

To summarize the above, by forming the slits 36 and the pilot port 37, it is ensured that pilot injection is performed only in the low speed, low load range and that pilot injection in the other ranges is canceled. A problem would arise in that the injection quantity would not change almost linearly relative to the control sleeve position as indicated with the broken line in FIG. 8, since, although the main injection becomes reduced in correspondence to the movement of the control sleeve 34 toward the small injection quantity position, the pilot injection would remain at a specific level without the constricting effect. However, since the pilot port 37 moves closer to the hypotenuse of the inflow/outflow ports 35 as the control sleeve 34 approaches the small injection quantity position and the inflow/outflow port 31 begins to communicate with the pilot port 37 before the slit 36 communicates with the pilot port 37, the pilot injection is reduced as the control sleeve 34 travels further toward the small injection quantity position. Thus, the injection quantity Q can be made to be almost in proportion to the control sleeve position, as indicated with the solid line characteristics curve in FIG. 8.

Note that, although the explanation is given in reference to the embodiment described above by using a VR type injection pump as an example, a similar mechanism may be provided in a VE type injection pump. In that case, since the distribution member makes reciprocal movement as well as the rotating movement, in a VE type injection pump, it goes without saying that the shapes and positional relationships of the inflow/outflow ports 31, the slits 36, the intake-cutoff hole 35 and the pilot port 37 will have to be adjusted.

As has been explained, according to the present invention, since first through holes, the number of which corresponds to the number of distributions and slits that extend from these through holes are provided at either the distribution member or the control sleeve and, at the other one of the distribution member or the control sleeve, a second through hole that communicates with the first through holes sequentially and a third through hole that communicates with the slits during part of the force feed period are provided. When a slit comes into communication with the third through hole during the force feed period, compressed fuel will be diverted in sufficient quantity at a low rotation rate and pilot injection takes place prior to the main injection. Also, at high rotation rates, even when the slit and the third through hole come into communication with each other, the diversion of compressed fuel is reduced or completely eliminated due to the constricting effect of the slit so that the pilot injection is canceled.

Moreover, the size of the area over which the slit and the third through hole overlap with each other when they communicate is varied in correspondence to the control sleeve position in such a manner that, as the control sleeve moves further toward the direction in which the fuel quantity increases, the size of the overlapping area of the slit and the third through hole is reduced. Thus, when the load is low (when the injection quantity is small), pilot injection is assured since the size of the overlapping area of the slit and the third through hole is large and, when the load is high (when the injection quantity is large), it can be assured that only the main injection takes place, due to the small size of the overlapping area of the slit and the third through hole.

As a result, ignition can be performed smoothly with pilot injection in the idling range and the no-load range during low speed, low load operation, reducing the generation of white smoke due to flame-out, also reducing NOx, and reducing the combustion noise because of the smooth engine ignition in the idling range. Furthermore, since pilot injection can be canceled during low speed, high load operation, the generation of black smoke can be prevented and improvement in both torque and fuel efficiency can be achieved as well.

Although, merely with the slits and the third through hole coming into communication with each other during low speed, low load operation, the pilot injection would continue in a specific quantity even when the main injection quantity is reduced, by making a first through hole and the third through hole communicate with each other earlier as the control sleeve approaches the small injection quantity position, the pilot injection quantity is reduced as the main injection quantity decreases and, as a result, the relationship between the entire injection quantity and the control sleeve position is made almost linear.

What is claimed is:

1. A distributor type fuel injection pump comprising:

a fuel chamber;

a fuel distribution member rotatably mounted in said fuel chamber for rotation in synchronization with an engine, said distribution member defining a compression space, and a flow passage providing fluid communication between said fuel chamber and said compression space; and a control sleeve slidably mounted on an external peripheral surface of said distribution member, said control sleeve being relatively movable along an axial direction of said distribution member, wherein:

a plurality of first through holes are formed in one of said distribution member and said control sleeve, and a plurality of slits extend in an axial direction of said distribution member from said plurality of first through holes, respectively;

a second through hole, which can communicate with said plurality of first through holes, is formed in the other of said distribution member and said control sleeve; and a third through hole, also formed in the other of said distribution member and said control sleeve, communicates with said slits during part of a force feed period.

2. The distributor type fuel injection pump as claimed in claim 1, wherein when said slits and said third through hole communicate, an overlap area is formed by said slits and said third through hole, and said overlap area changes in correspondence to a change in position of said control sleeve.

3. The distributor type fuel injection pump as claimed in claim 1, wherein upon communication between said slits and said third through hole, an overlap area is formed by said slits and said third through hole, and said overlap area is reduced as said control sleeve moves further in a direction corresponding to increased injected fuel quantity.

4. The distributor type fuel injection pump as claimed in claim 1, wherein said third through hole is slit which extends in an axial direction of said distribution member.

5. The distributor type fuel injection pump as claimed in claim 1, further comprising:

a plurality of plungers radially oriented relative to said distribution member and slidably mounted in said distribution member for movement into and out of said compression space;

a cam ring around said plurality of plungers, and positioned so as to be concentric with said distribution member; and a plurality of rollers each positioned between a base portion of one of said plurality of plungers and said cam ring, wherein said plungers reciprocate along a radial direction of said distribution member in response to rotation of said distribution member to change the volumetric capacity of said compression space.

6. The distribution type fuel injection pump as claimed in claim 5, wherein:

each of said plurality of first through holes has the shape of a triangle having a first side which is a trailing side of said triangle relative to a rotation direction of said distribution member and is parallel to the axial direction of said distribution member, and a second side which is a leading side of said triangle relative to a rotation direction of said distribution member and is inclined relative to the axial direction of said distribution member;

said second through hole has the shape of a triangle having a first side which determines initiation of communication with one of said plurality of first holes and is inclined relative to the axial direction of said distribution member, and a second side which is parallel to the axial direction of said distribution member and determines termination of communication with said one of said first holes; and an overlap area of said slits and said third through hole changes in response to a change in an axial position of said control sleeve relative to said distribution member.

7. The distributor type fuel injection pump as claimed in claim 6, wherein an effective stroke is defined when said second through hole terminates communication with one of said first through holes until said second through hole comes into communication with a following one of said first through holes, the effective stroke is small and the overlap area of said slits and said third through hole is large when the speed of an engine is low and the injection quantity is small.

8. The distributor type fuel injection pump as claimed in claim 6, wherein an effective stroke is defined when said second through hole terminates communication with one of said first through holes until said second through hole comes into communication with a following one of said first through holes, and the effective stroke is large and said overlap area of slits and said third through hole is small when the speed of the engine is low and the injection quantity is large.

9. The distributor type fuel injection pump as claimed in claim 6, wherein an effective stroke is defined when said second through hole terminates communication with one of said first through holes until said second through hole comes into communication with a following one of said first through holes, and the effective stroke is large and said overlap area of slits and said third through hole is small when the speed of the engine is high and the injection quantity is large.

10. The distributor type fuel injection pump as claimed in claim 6, wherein each of said plurality of first through holes has the shape of a right triangle, and when said control sleeve is near said small injection quantity position, said third through hole is made to engage the hypotenuse of said first through holes before said slits come into communication with said third through hole.

11. The distributor type fuel injection pump according to claim 1, wherein:

during an intake process, fuel can be supplied from said chamber to said compression space when one of said first through holes communicates with said second through hole;

during a force feed process, compressed fuel can be force fed when said one of said first through holes is not in communication with said second through hole;

while said force feed process is in progress, a communicating state between said compression space and said chamber is achieved when one of said slits communicates with said third through hole;

after said one of said slit ceases to communicate with said third through hole, a force feed state in which fuel is compressed in said compression space can be achieved; and when said second through hole comes into communication with a following first through hole of said first through holes, the force feed state will be terminated by fuel from said compression space flowing into said chamber.

12. The distributor type fuel injection pump according to claim 1, wherein when said control sleeve is near a small injection quantity position, one of said first through holes and said third through hole come into communication with each other before said third hole comes into communication with said slit extending from said one of said first through holes.

13. A vehicle having an engine and a distributor type fuel injection pump for supplying fuel to said engine, said distributor type fuel injection pump comprising:

a fuel chamber;

a fuel distribution member rotatably mounted in said fuel chamber for rotation in synchronization with said engine, said distribution member defining a compression space and a flow passage which provides fluid communication between said fuel chamber and said compression space; and a control sleeve mounted on an external peripheral surface of said distribution member, said control sleeve being relatively movable along an axial direction of said distribution member; wherein:

a plurality of first through holes are formed in one of said distribution member and said control sleeve, and a slit extends from each of said plurality of first through holes in an axial direction of said distribution member, a second through hole, which can communicate with said plurality of first through holes, is formed in the other of said distribution member and said control sleeve, and a third through hole, which communicates with said slits during part of a force feed period, is also formed in the other of said distribution member and said control sleeve.

* * * * *